US007819476B2

(12) United States Patent
Gong et al.

(10) Patent No.: US 7,819,476 B2
(45) Date of Patent: Oct. 26, 2010

(54) LIFT CHAIR AND A CHAIR BASE FRAME WITH A FORCE BALANCE MECHANISM FOR USE THEREWITH

(75) Inventors: Jiaxiong Gong, Changzhou (CN); Ming Yin, Changzhou (CN); Xiaojun Gong, Changzhou (CN); Quan Liu, Ames, IA (US); Xiaoxiang Zhang, La Palma, CA (US); Yongyong Mao, Shanghai (CN)

(73) Assignee: I-Trust Better Life Corp., Buena Park, CA (US)

( * ) Notice: Subject to any disclaimer, the term of this patent is extended or adjusted under 35 U.S.C. 154(b) by 532 days.

(21) Appl. No.: 11/648,267

(22) Filed: Dec. 29, 2006

(65) Prior Publication Data

US 2008/0001455 A1 Jan. 3, 2008

(30) Foreign Application Priority Data

Jun. 30, 2006 (CN) ..... 2006 3 0088570
Jul. 7, 2006 (CN) ..... 2006 3 0122026

(51) Int. Cl.
*A47C 1/02* (2006.01)

(52) U.S. Cl. ..... 297/344.17; 248/564

(58) Field of Classification Search ..... 297/344.12, 297/344.17, DIG. 10; 248/564
See application file for complete search history.

(56) References Cited

U.S. PATENT DOCUMENTS 1,025,915 A 5/1912 Hoff
3,138,402 A * 6/1964 Heyl, Jr. et al. ..... 297/69
3,984,078 A * 10/1976 Sturhan ..... 248/588
4,909,569 A 3/1990 Gaffney
4,946,222 A * 8/1990 Matson ..... 297/344.17
5,061,010 A * 10/1991 LaPointe ..... 297/325
5,342,114 A * 8/1994 Burke et al. ..... 297/344.2
5,901,610 A 5/1999 Schneider
5,918,505 A 7/1999 Jensen
5,931,532 A 8/1999 Kemmerer et al.
6,000,758 A 12/1999 Schaffner et al.
6,213,554 B1 * 4/2001 Marcoux et al. ..... 297/330
6,377,010 B1 4/2002 Roither
6,880,416 B2 4/2005 Koch
7,047,834 B2 5/2006 Nielsen et al.

(Continued)

FOREIGN PATENT DOCUMENTS

EP 0077280 A1 4/1983

*Primary Examiner*—Joseph F Edell
(74) *Attorney, Agent, or Firm*—Tim Tingkang Xia; Morris, Manning & Martin LLP

(57) ABSTRACT

A support frame for use in a lift chair. In one embodiment, the support frame includes a base frame having longitudinally spaced transversely extending front and rear frame base rails; a first longitudinally extending side frame base rail connected to the front and rear frame base rails and a second longitudinally extending side frame base rail connected to the front and rear frame base rails, respectively, the first and second side frame base rails and the front and rear frame base rails being co-planar for supporting the lift chair on a surface; and a force balance member mounted to the rear frame base rail. The force balance member has a transversely extending base portion, a first arm portion extending from the base portion at a first angle $\alpha_a$, and an opposite, second arm portion extending from the base portion at a second angle $\alpha_b$.

27 Claims, 7 Drawing Sheets

U.S. PATENT DOCUMENTS 7,066,041 B2 6/2006 Nielsen
7,090,297 B2 8/2006 Mohn et al.
7,137,489 B2 11/2006 Bastholm et al.
7,543,885 B2 * 6/2009 Pollard et al. ..... 297/85 R

* cited by examiner

LIFT CHAIR AND A CHAIR BASE FRAME WITH A FORCE BALANCE MECHANISM FOR USE THEREWITH

CROSS-REFERENCE TO RELATED PATENT APPLICATION

This application claims priority of Chinese Patent Application Nos. 200630122026.X, filed on Jul. 7, 2006, entitled "A CHAIR BASE FRAME" by Jiaxiong Gong, Ming Yin, and Xiaojun Gong, and 200630088570.7, filed on Jun. 30, 2006, entitled "A LINEARLY DRIVEN DEVICE" by Jiaxiong Gong, Ming Yin, and Xiaojun Gong, the disclosures of which are incorporated herein by reference in their entireties.

This application is related to a co-pending U.S. patent application, entitled "A LIFT CHAIR AND A CHAIR BASE FRAME WITH AN ACTUATOR FOR USE THEREWITH," by Jiaxiong Gong, Ming Yin, Xiaojun Gong, Quan Liu, Xiaoxiang Zhang, and Yongyong Mao (Ser. No. 11/648,232), which was filed on the same day that this application was filed, and with the same assignee as that of this application. The disclosure of the above identified co-pending application is incorporated herein by reference in its entirety.

Some references, which may include patents, patent applications and various publications, are cited in a reference list and discussed in the description of this invention. The citation and/or discussion of such references is provided merely to clarify the description of the present invention and is not an admission that any such reference is "currently available" to the invention described herein. All references cited and discussed in this specification are incorporated herein by reference in their entireties and to the same extent as if each reference was individually incorporated by reference.

FIELD OF THE INVENTION

The present invention generally relates to a chair base frame for use with a power driven reclining lift chair, and in particular to a chair base frame with a force balance mechanism that can be utilized in a lift chair that is capable of uniform motion and has a stronger support from the chair base frame.

BACKGROUND OF THE INVENTION

Lift chairs find widespread use in elderly, disabled and/or infirm persons. In reclining chairs a tiltable back and seat are driven between an erect and a reclined position, and a leg or foot rest is driven between a retracted and an extended position. A lift chair is powered between a normal seat position and an elevated forwardly inclined position. In various currently available reclining lift chairs the speed of motion or velocity of the back or seat or the leg or foot rest as sensed by the chair occupant changes or varies during the course of movements in the elevating or reclining mode. Additionally, in some currently available chairs there is some dwell that occurs at certain points in the motion. As partially shown in FIG. 7, a currently available reclining lift chair 700 has a base frame with several frame base rails including a rear frame base rail 714, and a motor 716 mounted to the front frame base 714 with a mounting means, such as a clevis pin, around a position 718. The motor 716 drives a motor extension shaft 734, which has a movable portion and connects with a bell crank 736. The bell crank 736 in turn can cause elevator arms 720 to rotate and lift. In such motion, the point of connection of the motor 716, which is around the position 718, with the rear frame base rail 714 will bear the impact and loading caused by the chair occupant and/or the motion. However, because of the point connection between the motor 716 and the rear frame base rail 714, the impact force and load is not uniformed distributed around the base frame, which may cause dwell and erratic, non-uniform movements that are disconcerting to the elderly users of the chairs. Moreover, the point connection between the motor 716 and the rear frame base rail 714 may further cause instability of the lift chair 700 when it is in use. Furthermore, the point connection between the motor 716 and the rear frame base rail 714 becomes a trouble spot because it is exposed to the impact force and load whenever the lift chair 700 is in use.

Therefore, a heretofore unaddressed need exists in the art to address the aforementioned deficiencies and inadequacies.

SUMMARY OF THE INVENTION

The present invention, in one aspect, relates to a support frame for use in a lift chair. In one embodiment, the support frame includes a base frame having longitudinally spaced transversely extending front and rear frame base rails, and a pair of transversely spaced longitudinally extending side frame base rails, rigidly connected to the front and rear frame base rails, remotely from ends of the front and rear frame base rails, respectively, the side frame base rails and the front and rear frame base rails being co-planar for supporting the lift chair on a surface.

The support frame further includes a force balance member mounted to the rear frame base rail in the neighborhood of a strategic position, where the force balance member is U-shaped and has a transversely extending base portion, a first arm portion, which is extending from the base portion at a first angle $\alpha_a$, and an opposite, second arm portion, which is extending from the base portion at a second angle $\alpha_b$, and where the end of the first arm portion is connected to one of the pair of transversely spaced longitudinally extending side frame base rails and the end of the second arm portion is connected to the other of the pair of transversely spaced longitudinally extending side frame base rails, respectively, such that the first angle $\alpha_a$ is nonzero and smaller than 90°, and the second angle $\alpha_b$ is nonzero and smaller than 90°. The first angle $\alpha_a$ and the second angle $\alpha_b$ are different or substantially same. In one embodiment, the first arm portion of the force balance member and corresponding portions of the rear frame base rail and side frame base rail enclose an area that is substantially triangular. The second arm portion of the force balance member and corresponding portions of the rear frame base rail and side frame base rail enclose an area that is substantially triangular.

The support frame also includes a pair of upstanding side plate members, fixedly connected to respective ones of the side frame base rails substantially at positions of connection thereof with the first arm portion and second arm portion, respectively.

Furthermore, the support frame includes a support member configured to engage with a motor and mounted to the force balance member and the rear frame base rail in the neighborhood of a strategic position. In one embodiment, the support member comprises a first L-shaped side plate member and a spaced apart, second L-shaped side plate member, which are respectively connected to a base plate member, and where the first L-shaped side plate member, second L-shaped side plate member and base plate member are configured such that when the support member is mounted to the force balance member and the rear frame base rail in the neighborhood of a strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively. Each of the first L-shaped side plate member and second L-shaped side plate member defines a hole.

In another aspect, the present invention relates to a support frame for use in a lift chair. In one embodiment, the support frame comprises a base frame having longitudinally spaced transversely extending front and rear frame base rails.

Furthermore, the support frame includes a first longitudinally extending side frame base rail connected to the front and rear frame base rails, and a second longitudinally extending side frame base rail connected to the front and rear frame base rails, respectively, the first and second side frame base rails and the front and rear frame base rails being co-planar for supporting the lift chair on a surface.

Moreover, the support frame includes a force balance member mounted to the rear frame base rail, where the force balance member has a transversely extending base portion, a first arm portion, which is extending from the base portion at a first angle $\alpha_a$, and an opposite, second arm portion, which is extending from the base portion at a second angle $\alpha_b$, and where the end of the first arm portion is connected to the first longitudinally extending side frame base rail and the end of the second arm portion is connected to the second longitudinally extending side frame base rail, respectively. In one embodiment, the first angle $\alpha_a$ is nonzero and smaller than 90°, and the second angle $\alpha_b$ is nonzero and smaller than 90°. The first angle $\alpha_a$ and the second angle $\alpha_b$ are different or substantially same. The first arm portion of the force balance member and corresponding portions of the rear frame base rail and side frame base rail enclose an area that is substantially triangular. The second arm portion of the force balance member and corresponding portions of the rear frame base rail and side frame base rail enclose an area that is substantially triangular.

Additionally, the support frame includes a pair of upstanding side plate members, fixedly connected to respective ones of the side frame base rails substantially at positions of connection thereof with the first arm portion and second arm portion, respectively.

The support frame further includes a support member configured to engage with a motor and mounted to the force balance member and the rear frame base rail in the neighborhood of a strategic position.

In one embodiment, the strategic position is substantially coincident with the geometric center of the rear frame base rail. The first arm portion and the second arm portion are formed to be substantially symmetric about an axis A passing through the geometric center of the rear frame base rail. The rear frame base rail has a first end portion and an opposite, second end portion and a transversely extending body defined therebetween, where the first end portion is bended away from the transversely extending body of the rear frame base rail in a direction opposite to the direction that the first arm portion of the force balance member is bended away from the transversely extending base portion of the force balance member, and the second end portion is bended away from the transversely extending body of the rear frame base rail in a direction opposite to the direction that the second arm portion of the force balance member is bended away from the transversely extending base portion of the force balance member, and where the first end portion and the second end portion are formed to be substantially symmetric about the axis A.

In one embodiment, the support member comprises a first L-shaped side plate member and a spaced apart, second L-shaped side plate member, which are respectively connected to a base plate member, and where the first L-shaped side plate member, second L-shaped side plate member and base plate member are configured such that when the support member is mounted to the force balance member and the rear frame base rail in the neighborhood of a strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively. Each of the first L-shaped side plate member and second L-shaped side plate member defines a hole.

In yet another aspect, the present invention relates to a lift chair. In one embodiment, the lift chair has a seat portion for supporting a chair occupant and a motor member having an extendible shaft portion for extending or retracting according to direction of motor rotation.

The lift chair further has a support frame for supporting the seat portion. The support frame comprises a base frame having longitudinally spaced transversely extending front and rear frame base rails; a first longitudinally extending side frame base rail connected to the front and rear frame base rails, and a second longitudinally extending side frame base rail connected to the front and rear frame base rails, respectively, the first and second side frame base rails and the front and rear frame base rails being co-planar for supporting the lift chair on a surface; a force balance member mounted to the rear frame base rail, where the force balance member has a transversely extending base portion, a first arm portion, which is extending from the base portion at a first angle $\alpha_a$, and an opposite, second arm portion, which is extending from the base portion at a second angle $\alpha_b$, and where the end of the first arm portion is connected to the first longitudinally extending side frame base rail and the end of the second arm portion is connected to the second longitudinally extending side frame base rail, respectively. In one embodiment, the first angle $\alpha_a$ is nonzero and smaller than 90°, and the second angle $\alpha_b$ is nonzero and smaller than 90°. The first angle $\alpha_a$ and the second angle $\alpha_b$ are different or substantially same. The first arm portion of the force balance member and corresponding portions of the rear frame base rail and side frame base rail enclose an area that is substantially triangular. The second arm portion of the force balance member and corresponding portions of the rear frame base rail and side frame base rail enclose an area that is substantially triangular.

In one embodiment, the support frame further comprises a pair of upstanding side plate members, fixedly connected to respective ones of the side frame base rails substantially at positions of connection thereof with the first arm portion and second arm portion, respectively.

The lift chair also has a support member configured to engage with the motor and mounted to the force balance member and the rear frame base rail in the neighborhood of a strategic position.

The motor member is pivotally connected to the support member of the support frame for actuating motion of the motor upon extension/retraction of the motor shaft, thereby causing the seat portion to move from a first position to a second position in operation.

In one embodiment, the support member comprises a first L-shaped side plate member and a spaced apart, second L-shaped side plate member, which are respectively connected to a base plate member, and where the first L-shaped side plate member, second L-shaped side plate member and base plate member are configured such that when the support member is mounted to the force balance member and the rear frame base rail in the neighborhood of a strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively. Each of the first L-shaped side plate member and second L-shaped side plate member defines a hole.

Furthermore, the lift chair has a back portion and a leg support and/or foot rest portion, and driving means for moving the seat, back and leg support and/or foot rest portions in response to the motor from the first position to the second position, or vice versa.

The support frame further has a lifting member for lifting said seat, back and leg support portions of the lift chair into a desired position. The lifting member comprises an elevator frame. The elevator frame includes longitudinally spaced transversely extending front and rear elevator frame members; each of the front and rear elevator frame members having a central portion, intermediate portions extending generally downwardly from respective end portions of the central portion and being connected thereto via a gentle curvature, and extremity portions extending outwardly in a gentle curvature in a transverse direction from respective lower portions of the intermediate extending portions; a pair of transversely spaced longitudinally extending elevator frame side members, rigidly connected to respective end portions of the central portions of the front and rear elevator frame members, such that the pair of transversely spaced longitudinally extending elevator frame side members and the central portions of the front and rear elevator frame members are coplaner, where each of the pair of transversely spaced longitudinally extending elevator frame side members has a tab extending from one end portion of the elevator frame side member that is connected to the front elevator frame members; and a pair of transversely spaced longitudinally extending elevator frame side rails, rigidly connected to respective ends of the extremity portions of the front and rear elevator frame members, such that the pair of transversely spaced longitudinally extending elevator frame side rails and the extremity portions of the front and rear elevator frame members are co-planer.

The lifting member also comprises a first pair of transversely spaced longitudinally extending elevator arms rigidly connected by one or more transversely extending bars, each of the first pair of transversely spaced longitudinally extending elevator arms having a first end portion and an opposite, second end portion, where the first end portions of the first pair of transversely spaced longitudinally extending elevator arms are pivotally mounted to respective ones of the extending tabs of the pair of transversely spaced longitudinally extending elevator frame side members, and the second end portions of the first pair of transversely spaced longitudinally extending elevator arms are pivotally mounted to respective ones of the pair of upstanding side plate members, respectively.

The lifting member further comprises a second pair of transversely spaced longitudinally extending elevator arms rigidly connected by one or more transversely extending bars, each of the second pair of transversely spaced longitudinally extending elevator arms having a first end portion and an opposite, second end portion, where the first end portions of the second pair of transversely spaced longitudinally extending elevator arms are pivotally mounted to respective ones of the extending tabs of the pair of transversely spaced longitudinally extending elevator frame side members, and the second end portions of the second pair of transversely spaced longitudinally extending elevator arms are pivotally mounted to respective ones of the pair of upstanding side plate members, respectively, such that the elevator frame is operably movable from a first position to a second portion relative to the support frame.

In one embodiment, the elevator frame further comprises an engaging member rigidly connected to a position of the central portion of the front elevator frame members.

The lift chair may also have a crank member having a first end portion pivotally connected to the engaging member of the elevator frame and a second end portion pivotally connected to the motor shaft portion for rotation responsively to extension/retraction of the motor shaft portion.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
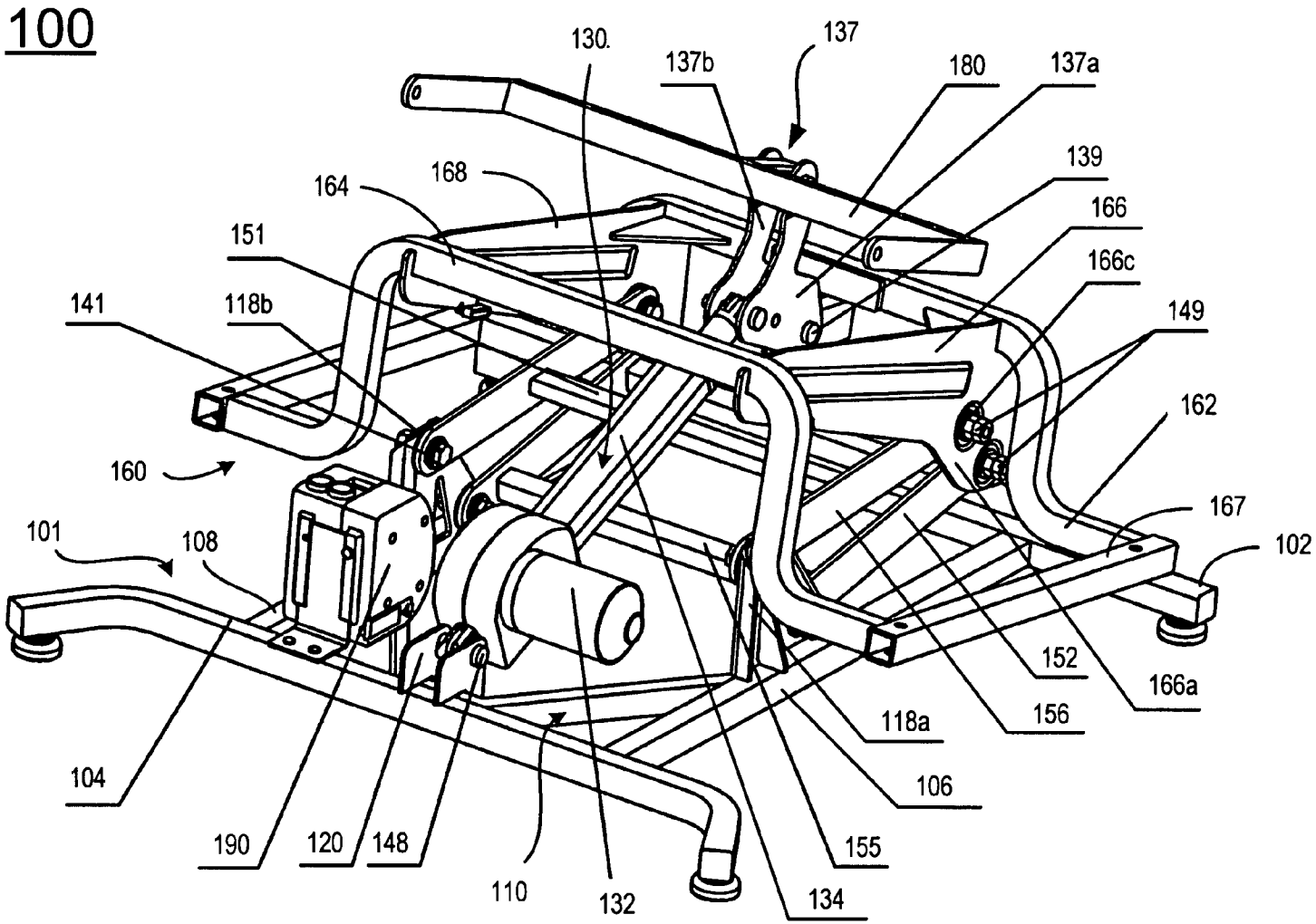
FIG. 1 shows a perspective view of a lift chair frame in one position according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings in FIGS. 1-6. In accordance with the purposes of this invention, as embodied and broadly described herein, this invention, in one aspect, relates to a support frame and a lift chair having the support frame in support for a seat portion, a back portion and a leg support and/or foot rest portion of the lift chair.

Referring to FIGS. 1-5, a support frame 100 for use in a lift chair is shown according to one embodiment of the present invention. The support frame 100 includes a base frame 101. The base frame 101 has longitudinally spaced transversely extending front and rear frame base rails 102 and 104 and a pair of transversely spaced longitudinally extending side frame base rails 106 and 108, which are rigidly connected to the front and rear frame base rails 102 and 104 remotely from the ends of the front and rear frame base rails 102 and 104, respectively, such that the pair of side frame base rails 106 and 108 and the front and rear frame base rails 102 and 104 are co-planar for supporting a lift chair on a surface such as a floor. Preferably, the connection of the pair of side frame base rails 106 and 108 to the front and rear frame base rails 102 and 104 is by welding ends of the pair of side frame base rails 106, 108 onto desired positions of the front and rear frame base rails 102 and 104. Other connecting means or methods can also be utilized to practice the present invention. Each of the front and rear frame base rails 102 and 104 and the pair of side frame base rails 106 and 108 can be a tubular bar or a solid bar having a cross section of rectangle or other geometric shapes.

The support frame 100 further includes a force balance member 110 that is rigidly mounted, preferably welded, to the rear frame base rail 104 in the neighborhood of a strategic position 116. As shown in FIG. 3A, the strategic position 116 is substantially coincident with the geometric center of the rear frame base rail 104. The force balance member 110 to a degree is U-shaped and has a transversely extending base portion 112, a first arm portion 114*a*, which is extending from the base portion 112 at a first angle $\alpha_a$, and an opposite, second arm portion 114*b*, which is extending from the base portion 112 at a second angle $\alpha_b$, as shown in FIG. 3A.

Figure 2:
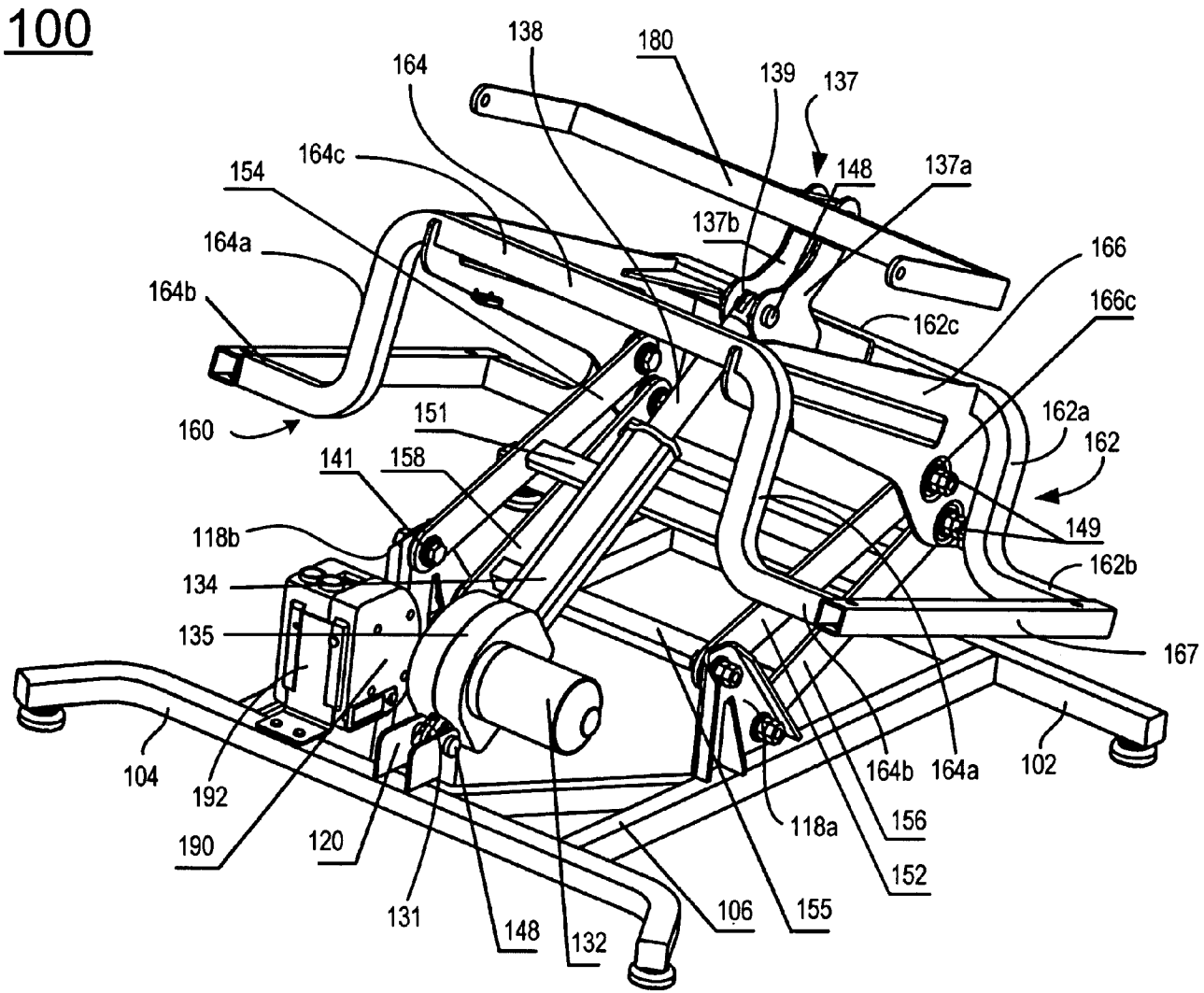
FIG. 2 shows a perspective view of the lift chair frame shown in FIG. 1 in another position.
Figure 3:
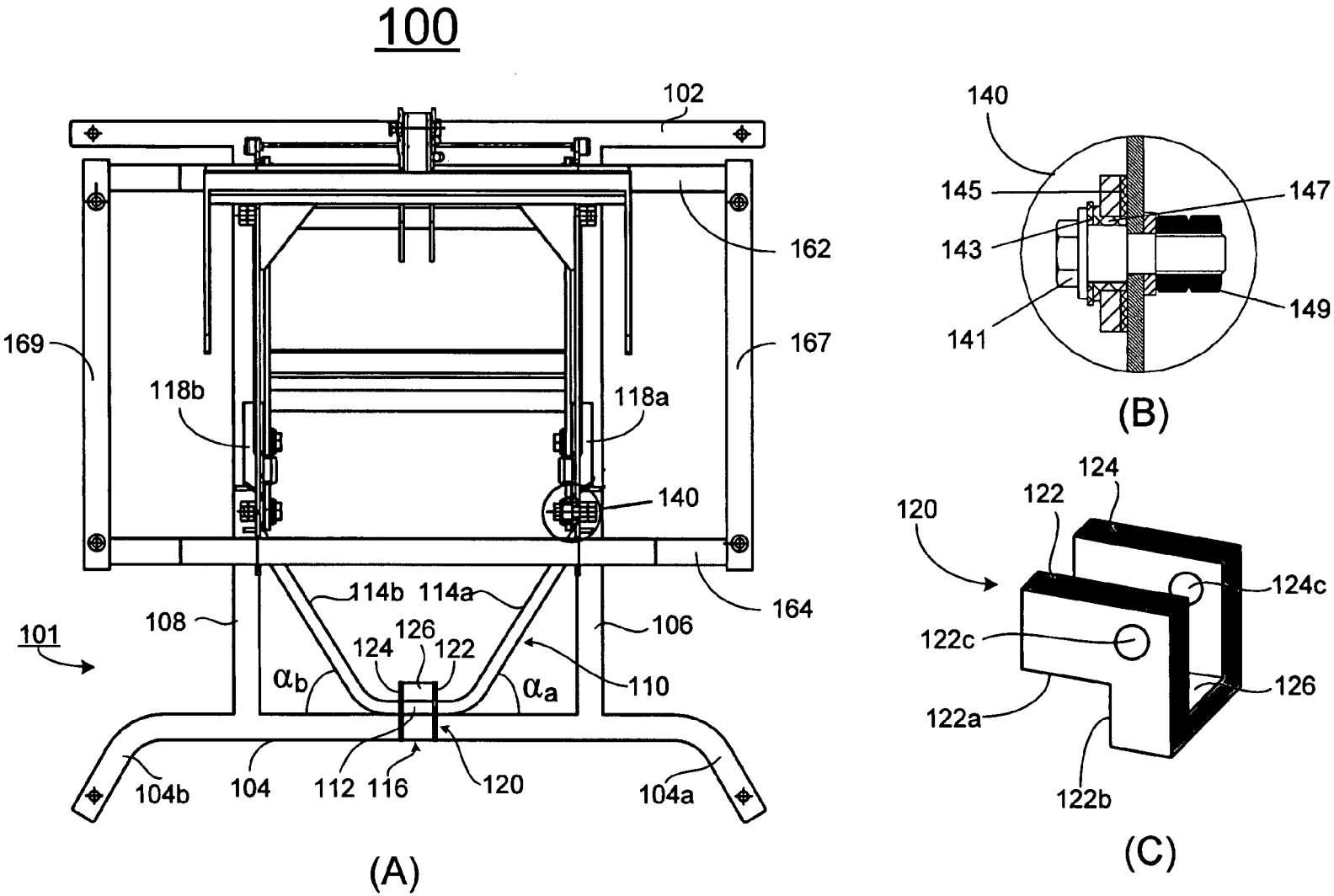
FIG. 3 shows (A) a top view of the lift chair frame shown in FIG. 1, (B) a partial enlarged view of a portion of the lift chair frame, and (C) a perspective view of a support member utilized in the lift chair frame.
Figure 4:
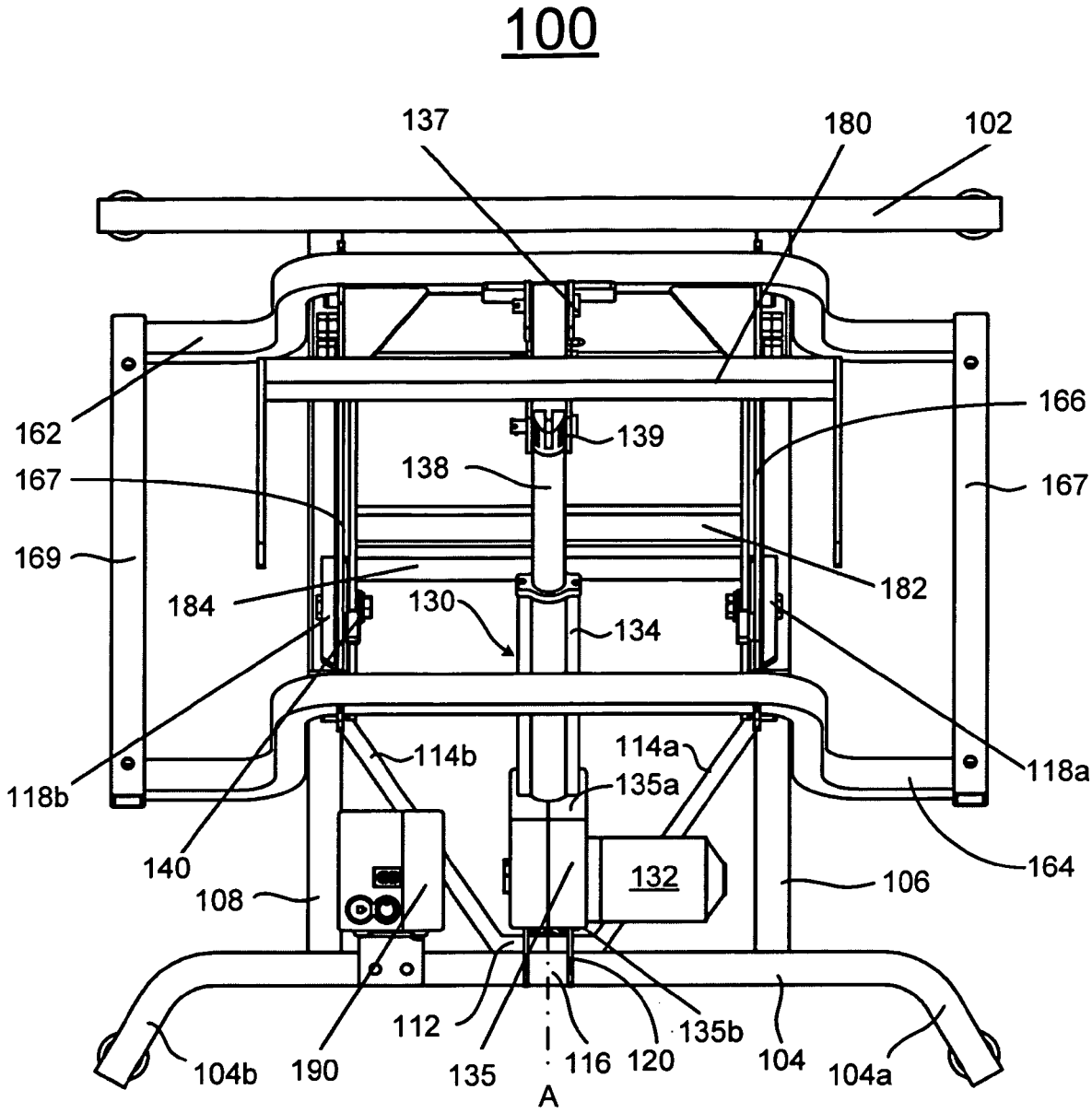
FIG. 4 is a front view of the lift chair frame shown in FIG. 1.
Figure 5:
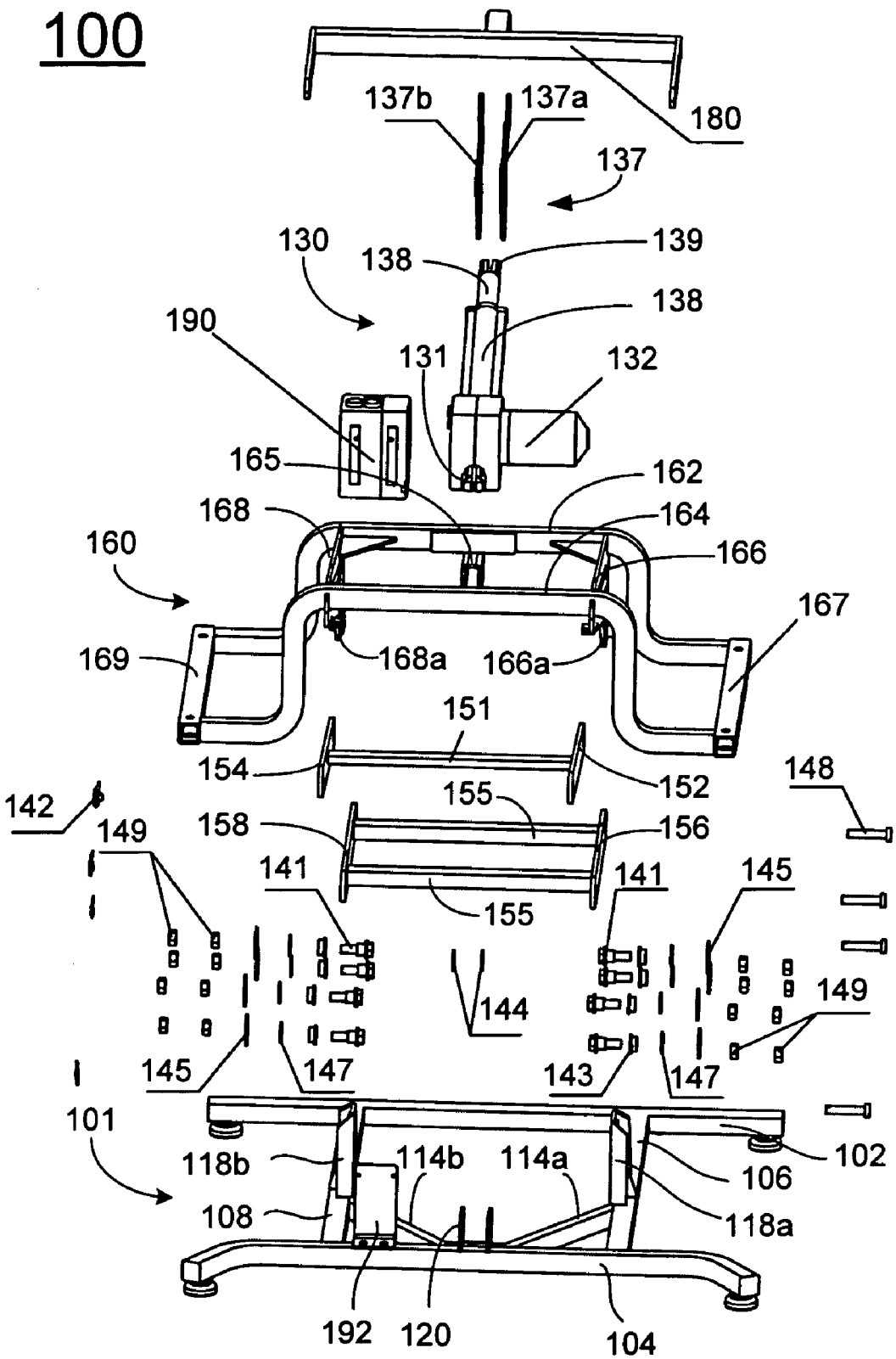
FIG. 5 is an exploding view of the lift chair frame shown in FIG. 1.

The first arm portion 114*a* and the second arm portion 114*b* of the force balance member 110 are formed to be substantially symmetric about an axis A passing through the geometric center of the rear frame base rail 104. The end of the first arm portion 114*a* of the force balance member 110 is connected to the side frame base rail 106 and the end of the second arm portion 114*b* of the force balance member 110 is connected to the side frame base rail 108, respectively, preferably by welding. In this embodiment, each of the first angle $\alpha_a$ and the second angle $\alpha_b$ is nonzero and smaller than 90°. The first angle $\alpha_a$ and the second angle $\alpha_b$ can be different or substantially same. As assembled, the first arm portion 114*a* of the force balance member 110 and corresponding portions of the rear frame base rail 104 and side frame base rail 106 enclose an area that is substantially triangular. The second arm portion 114*b* of the force balance member 110 and corresponding portions of the rear frame base rail 104 and side frame base rail 108 enclose an area that is substantially triangular. This configuration allows the force received at the junction, i.e., the neighborhood of the strategic position 116, of the rear-frame base rail 104 and the force balance member 110 during operation to be distributed to the rear frame base rail 104 and also to the side frame base rails 106, 108 through the first and second arm portions 114*a*, 114*b*, respectively, which allows a uniform distribution of force in the support frame 100 and provides enhanced support to the structure. Moreover, this configuration provides additional stability to the support frame at least because the two triangular structures formed by the rear frame base rail 104, side frame base rails 106, 108 and the force balance member 110. As shown in FIGS. 1-3, the force balance member 110 is a tubular bar or a solid bar having a rectangular cross section. A balance member having a cross section of other geometric shapes can also be utilized to practice the present invention.

As shown in FIGS. 1-5, the rear frame base rail 104 has a first end portion 104*a* and an opposite, second end portion 104*b* and a transversely extending body defined therebetween. The first end portion 104*a* is bended away from the transversely extending body of the rear frame base rail 104 in a direction opposite to the direction that the first arm portion 114*a* of the force balance member 110 is bended away from the transversely extending base portion 112 of the force balance member 110. The second end portion 104*b* is bended away from the transversely extending body of the rear frame base rail 104 in a direction opposite to the direction that the second arm portion 114*b* force balance member 110 is bended away from the transversely extending base portion 112 of the force balance member 110. The first end portion 104*a* and the second end portion 104*b* are formed to be substantially symmetric about the axis A. This configuration allows additional stability to the support frame 110.

The support frame 100 also includes a pair of upstanding side plate members 118*a* and 118*b* fixedly connected to respective ones of the side frame base rails 106 and 108 substantially at positions of connection thereof with the first arm portion 114*a* and second arm portion 114*b*, respectively, preferably by welding. Each of the pair of upstanding side plate members 118*a* and 118*b* defines a first and second hole therein.

Furthermore, the support frame 100 includes a support member 120 configured to engage with a motor member or actuator 130 and mounted to the force balance member 110 and the rear frame base rail 104 in the neighborhood of the strategic position 116. Preferably, the support member 120 is welded to the force balance member 110 and the rear frame base rail 104 in the neighborhood of the strategic position 116 for providing strong support for the motor member 130

As shown in FIG. 3C, the support member 120 has a first L-shaped side plate member 122 and a spaced apart, second L-shaped side plate member 124, which are respectively connected to a base plate member 126. The first L-shaped side plate member 122, second L-shaped side plate member 124 and base plate member 126 are configured such that when the support member 120 is mounted to the force balance member 110 and the rear frame base rail 104 in the neighborhood of a strategic position 116, a lower side 122*a* of the first L-shaped side plate member 122 is fixedly connected to and supported by an upper side 104*a* of the rear frame base rail 104 at a corresponding position, a contact side 122*b* of the first L-shaped side plate member 122 is fixedly connected to the transversely extending base portion 112 of the force balance member 110 at a corresponding position, a lower side 124*a* of the second L-shaped side plate member 124 is fixedly connected to and supported by the upper side 104*a* of the rear frame base rail 104 at a corresponding position, a contact side 124*b* of the second L-shaped side plate member 124 is fixedly connected to the transversely extending base portion 112 of the force balance member 110 at a corresponding position, and a side of the base plate member 126 is fixedly connected to the transversely extending base portion 112 of the force balance member 110 at a corresponding position, respectively. Each of the first L-shaped side plate member 122 and second L-shaped side plate member 124 defines a hole 122*c* or 124*c*. Preferably, the support member 120 is formed with one piece of steel, or other metallic materials.

Moreover, the support frame 100 has a lifting member having an elevator frame 160. The elevator frame 160 includes longitudinally spaced transversely extending front and rear elevator frame members 162 and 164. As shown in FIG. 2, each of the front and rear elevator frame members 162 and 164 has a central portion 162*c*, two intermediate portions 162*a* extending generally downwardly from respective end portions of the central portion 162*c* and being connected thereto via a gentle curvature, and two extremity portions 162*b*, 162*e* extending outwardly in a gentle curvature in a transverse direction from respective lower portions of the two intermediate extending portions 162*a*. In the embodiment, each of the front and rear elevator frame members 162 and 164 is a tubular or solid bar having a rectangular cross section. Other types of the front and rear elevator frame members can also be used to practice the present invention.

The elevator frame 160 also includes a pair of transversely spaced longitudinally extending elevator frame side members 166 and 168 that are rigidly connected to respective end portions of the central portions 162*c* and 164*c* of the front and rear elevator frame members 162 and 164, preferably by welding. In this embodiment, the pair of elevator frame side members 166 and 168 and the central portions 162*c*, 164*c* of the front and rear elevator frame members 162 and 164 are co-planer. Each of the pair of transversely spaced longitudinally extending elevator frame side members 166 and 168 has a tab 166*a*, 168*a* extending from one end portion of the elevator frame side member 166 or 168 that is connected to the front elevator frame members 162. Each tab 166*a*, 168*a* defines two spaced apart holes 166*c* therein. In the embodiment shown in FIGS. 1-6, each of the elevator frame side members 166 and 168 is a plate-like member. Other types of the elevator frame side members the elevator frame side members, for example, a tubular or solid bar having a rectangular cross session, can also be utilized to practice the present invention.

The elevator frame 160 further includes a pair of transversely spaced longitudinally extending elevator frame side rails 167 and 169 that are rigidly connected to respective ends of the extremity portions 162*b* and 164*b* of the front and rear elevator frame members 162 and 164, such that the pair of transversely spaced longitudinally extending elevator frame side rails 167 and 169 and the extremity portions 162*b* and 164*b* of the front and rear elevator frame members 162 and 164 are co-planer. In the embodiment, each of the elevator frame side rails 167 and 169 is a tubular or solid bar having a rectangular cross section. Other types of the elevator frame side rails can also be used to practice the present invention.

The lifting member also includes a first pair of transversely spaced longitudinally extending elevator arms 152 and 154 that are rigidly connected by one or more a transversely extending bar 151, preferably by welding. Each of the first pair of transversely spaced longitudinally extending elevator arms 152 and 154 has a first end portion defining a hole therein and an opposite, second end portion defining a hole therein. The first end portions of the first pair of elevator arms 152 and 154 are pivotally mounted to respective ones of the extending tabs 166*a* and 168*a* of the pair of elevator frame side members 166 and 168 of the elevator frame 160, while the second end portions of the first pair of elevator arms 152 and 154 are pivotally mounted to respective ones of the pair of upstanding side plate members 118*a* and 118*b*.

The lifting member further includes a second pair of transversely spaced longitudinally extending elevator arms 156 and 158 that are rigidly connected by two longitudinally spaced transversely extending bars 155, preferably by welding. Each of the second pair of elevator arms 156 and 158 having a first end portion defining a hole therein and an opposite, second end portion defining a hole therein. The first end portions of the second pair of elevator arms 156 and 158 are pivotally mounted to respective ones of the extending tabs 166*a* and 168*a* of the pair of elevator frame side members 166 and 168 of the elevator frame 160, and the second end portions of the second pair of elevator arms 156 and 158 are pivotally mounted to respective ones of the pair of upstanding side plate members 118*a* and 118*b*, respectively.

In the embodiment as shown in FIGS. 1-5, each of the first and second pairs of elevator arms 152, 154, 156 and 158 is pivotally connected to the corresponding upstanding side plate member 118*a* or 118*b* and the corresponding extending tab 166*a* or 168*a* of the pair of elevator frame side members 166 and 168 of the elevator frame 160 by screws 141 that passes through the corresponding holes of the first and second end portions of an elevator arm, an upstanding side plate member, and an extending tab, together with washers 143, 145 and 147, which are secured by nuts 149, as shown in FIG. 3B.

As assembled, the elevator frame 160 is operably movable from a first position to a second portion relative to the support frame 101 and vice versus, according to the rotation of the motor extending shaft of the motor member or an actuator 130, as described below.

The support frame 100 has a crank member 137 with a triangular configuration having a first to third vortex portion formed with two parallel plates 137*a* and 137*b* that are preferably identical one to another. The crank member 137 is pivotally connected to an engaging member 165 that is welded to a position of the central portion 162*c* of the front elevator frame members 162, at the first vortex portion of the triangular configuration. The crank member 137 is also pivotally connected to a T-bracket member 180 that is engaged with a seat portion (not shown) for supporting a chair occupant, at the second vortex portion of the triangular configuration.

The support frame 100 also has a motor member or actuator 130. In the embodiment as shown in FIGS. 1-5, the actuator 130 has a housing 135, an engaging member 131 that is fixedly connected with the housing 135 and protruding away from a rear end 135*b* of the housing 135, and an outer tube member 134 that extends through an opening defined in a front end 135*a* of the housing 135 and has a central axis that is coincident with the axis A, and an extension shaft (activation rod) 138 received in the outer tube member 134, engaged with the motor and configured to be telescopically movable relative to said outer tube member 134 according to a direction of motor rotation. The motor extension shaft 138 has a distal end portion 139 that is pivotally connected to the third vortex portion of the crank member 137, while the engaging member 131 of the actuator 130 is pivotally connected to the support member 120 of the base frame 101.

The motor 132 is preferably a low voltage, reversible DC motor. A transformer 190 attached to a bracket 192 that is fixed mounted onto the rear frame base rail 104 of the base frame 101 is adapted for providing a low voltage DC power to the motor 132. The transformer 190 itself is connectable to an outside AC power source for receiving an AC current and then converting it to a DC current. A battery can also be utilized.

For such an arrangement, the rotation of the motor 132 is converted to linear motion along the central axis A, through a worm gear-rack combination, and causes the actuation rod 138 to extend or retract, thereby causing the elevator frame 160 to move from one position to another position, and accordingly adjusting the seat position of a lift chair utilizing the support frame 100.

In operation, the occupant or operator actuates control means (not shown) of the chair so that the motor 132, through the action of a worm gear affixed to the motor output shaft, and a rack within the motor extension shaft 138, causes the motor extension shaft 138 to retract or extend, depending on the instruction of the occupant or operator, thereby causing the crank member 137 and the elevator frame 160 of the support frame 100 to move and rotate from one position to another position. The position including orientation of the frame 160 can be characterized a height, H2, of the rear portion of the elevator 160 and a height, H1, of the front portion of the elevator 160. When the motor extension shaft 138 extends, the elevator frame 160 moves upward and rotates clockwise from the rear portion to the front portion of the elevator frame 160 such that the height H2 of the rear portion of the elevator 160 increases, while the height H1 of the front portion of the elevator 160 decreases. When the motor extension shaft 138 extracts, the elevator frame 160 moves downward and rotates anticlockwise from the front portion to the rear portion of the elevator frame 160 such that the height H2 of the rear portion of the elevator 160 decreases, while the height H1 of the front portion of the elevator 160 increases.

Figure 6:
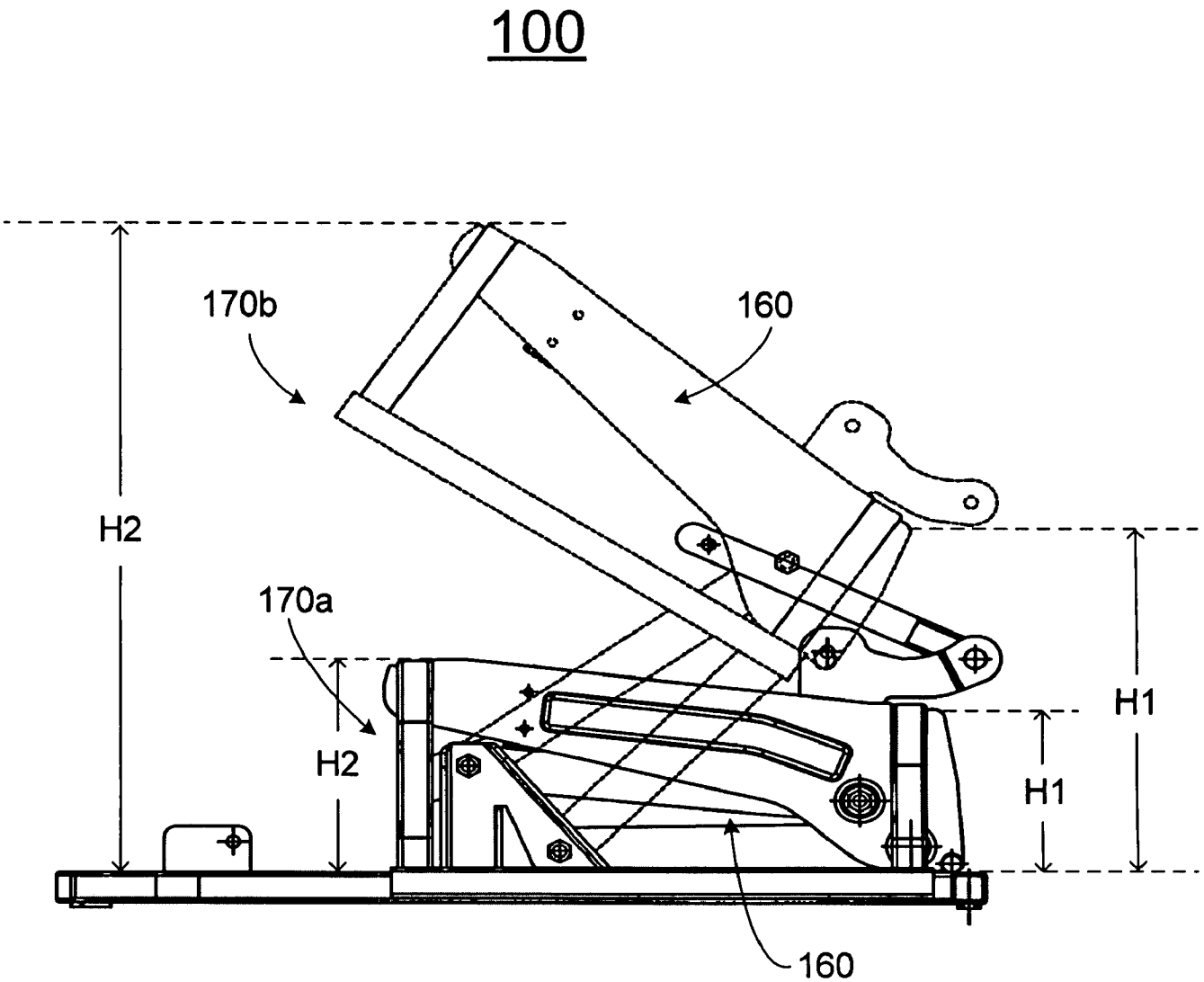
FIG. 6 is a side view of the lift chair frame shown in FIG. 1.
Figure 7:
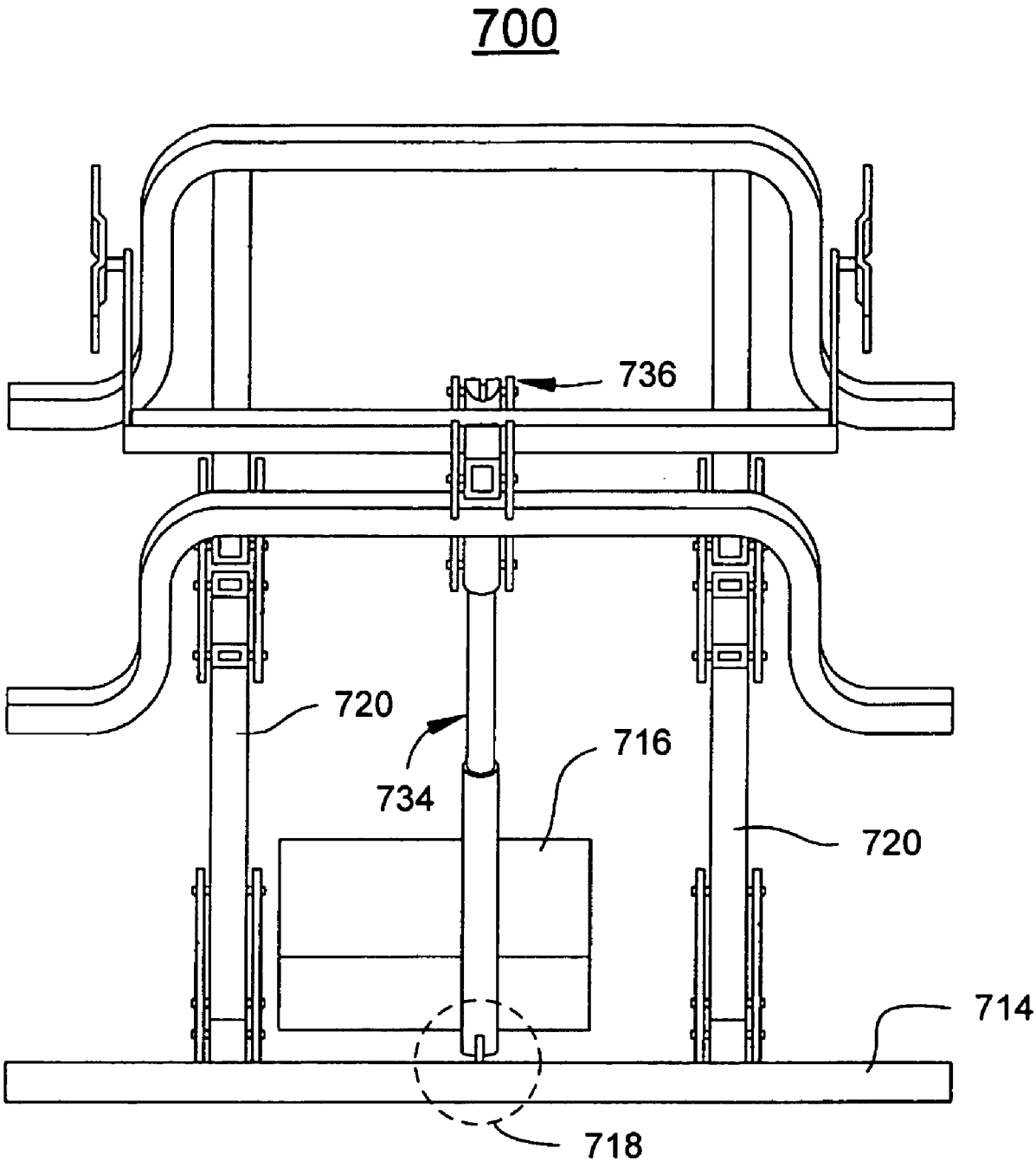
Fig. 7 (Related Art)
FIG. 7 is a front view of a conventional lift chair frame.

FIG. 6 shows an initial sitting position 170*a* and a declined position 170*b* of the support frame 100, therefore the chair (not shown) utilizing the support frame 100. At the initial sitting position 170*a*, the elevator frame 160 (seat portion) is slightly sloped from front to rear to provide comfortable seating for the occupant. As shown in FIG. 6, at this position, the height H2 of the rear portion of the elevator 160 is slightly greater than the height H1 of the front portion of the elevator 160. At the declined position 170*b*, the elevator frame 160 (seat portion) is significantly sloped such that the height H2 of the rear portion of the elevator 160 is much greater than the height H1 of the front portion of the elevator 160.

Preferably, the base frame, the elevator arms, the elevator frame, and the crank member are made from durable materials such as steel, alloy, plastic, wood, or any combination of them, as known to people skilled in the art.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A support frame for use in a lift chair, comprising:

(a) a base frame having longitudinally spaced transversely extending front and rear frame base rails;

(b) a pair of transversely spaced longitudinally extending side frame base rails, rigidly connected to the front and rear frame base rails, remotely from ends of the front and rear frame base rails, respectively, the side frame base rails and the front and rear frame base rails being coplanar for supporting the lift chair on a surface;

(c) a force balance member mounted to the rear frame base rail in at a strategic position, wherein the force balance member is U-shaped and has a transversely extending base portion, a first arm portion, which is extending from the base portion at a first angle $\alpha_a$, and an opposite, second arm portion, which is extending from the base portion at a second angle $\alpha_b$, and wherein the end of the first arm portion is directly connected to one of the pair of transversely spaced longitudinally extending side frame base rails and the end of the second arm portion is directly connected to the other of the pair of transversely spaced longitudinally extending side frame base rails, respectively, such that the first angle $\alpha_a$ is nonzero and smaller than 90°, and the second angle $\alpha_b$ is nonzero and smaller than 90°;

(d) a pair of upstanding side plate members, fixedly connected approximately midway between the front and rear frame base rails to respective ones of the side frame base rails substantially at positions of connection thereof with the first arm portion and second arm portion, respectively; and (e) a support member configured to engage with a motor and mounted to the force balance member and the rear frame base rail at the strategic position, wherein the strategic position is substantially coincident with the geometric center of the rear frame base rail.

2. The support frame of claim 1, wherein the support member comprises a first L-shaped side plate member and a spaced apart, second L-shaped side plate member, which are respectively connected to a base plate member, and wherein the first L-shaped side plate member, second L-shaped side plate member and base plate member are configured such that when the support member is mounted to the force balance member and the rear frame base rail at the strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively.

3. The support frame of claim 2, wherein each of the first L-shaped side plate member and second L-shaped side plate member defines a hole.

4. The support frame of claim 1, wherein the first arm portion of the force balance member and corresponding portions of the rear frame base rail and side frame base rail enclose an area that is substantially triangular.

5. The support frame of claim 4, wherein the second arm portion of the force balance member and corresponding portions of the rear frame base rail and side frame base rail enclose an area that is substantially triangular.

6. The support frame of claim 1, wherein the first angle $\alpha_a$ and the second angle $\alpha_b$ are different or substantially same.

7. A support frame for use in a lift chair, comprising:

(a) a base frame having longitudinally spaced transversely extending front and rear frame base rails;

(b) a first longitudinally extending side frame base rail connected to the front and rear frame base rails, and a second longitudinally extending side frame base rail connected to the front and rear frame base rails, respectively, the first and second side frame base rails and the front and rear frame base rails being co-planar for supporting the lift chair on a surface; and (c) a force balance member mounted to the rear frame base rail at a strategic position, wherein the force balance member has a transversely extending base portion, a first arm portion, which is extending from the base portion at a first angle $\alpha_a$, and an opposite, second arm portion, which is extending from the base portion at a second angle $\alpha_b$, and wherein the end of the first arm portion is directly connected to the first side frame base rail and the end of the second arm portion is directly connected to the second side frame base rail, respectively; a pair of upstanding side plate members, fixedly connected approximately midway between the front and rear frame base rails to respective ones of the side frame base rails substantially at positions of connection thereof with the first arm portion and second arm portion, respectively; and (d) a support member configured to engage with a motor and mounted to the force balance member and the rear frame base rail at the strategic position, wherein the strategic position is substantially coincident with the geometric center of the rear frame base rail.

8. The support frame of claim 7, wherein the support member comprises a first L-shaped side plate member and a spaced apart, second L-shaped side plate member, which are respectively connected to a base plate member, and wherein the first L-shaped side plate member, second L-shaped side plate member and base plate member are configured such that when the support member is mounted to the force balance member and the rear frame base rail at the strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively.

9. The support frame of claim 8, wherein each of the first L-shaped side plate member and second L-shaped side plate member defines a hole.

10. The support frame of claim 9, wherein the first arm portion and the second arm portion are formed to be symmetric about an axis A passing through the geometric center of the rear frame base rail.

11. The support frame of claim 10, wherein the rear frame base rail has a first end portion and an opposite, second end portion, and a transversely extending body defined therebetween, wherein the first end portion is bended away from the transversely extending body of the rear frame base rail in a direction opposite to the direction that the first arm portion of the force balance member is bended away from the transversely extending base portion of the force balance member, and the second end portion is bended away from the transversely extending body of the rear frame base rail in a direction opposite to the direction that the second arm portion of the force balance member is bended away from the transversely extending base portion of the force balance member, and wherein the first end portion and the second end portion are formed to be symmetric about the axis A.

12. The support frame of claim 7, wherein the first angle $\alpha_a$ is nonzero and smaller than 90°, and the second angle $\alpha_b$ is nonzero and smaller than 90°.

13. The support frame of claim 12, wherein the first arm portion of the force balance member and corresponding portions of the rear frame base rail and side frame base rail enclose an area that is substantially triangular.

14. The support frame of claim 13, wherein the second arm portion of the force balance member and corresponding portions of the rear frame base rail and side frame base rail enclose an area that is substantially triangular.

15. The support frame of claim 12, wherein the first angle $\alpha_a$ and the second angle $\alpha_b$ are different or substantially same.

16. A lift chair having a seat portion for supporting a chair occupant, comprising:

(a) a motor member having an extendible shaft portion for extending or retracting according to direction of motor rotation; and (b) a support frame for supporting the seat portion, the support frame comprising:

(i) a base frame having longitudinally spaced transversely extending front and rear frame base rails;

(ii) a first longitudinally extending side frame base rail connected to the front and rear frame base rails, and a second longitudinally extending side frame base rail connected to the front and rear frame base rails, respectively, the first and second side frame base rails and the front and rear frame base rails being co-planar for supporting the lift chair on a surface;

(iii) a force balance member mounted to the rear frame base rail at a strategic position, wherein the force balance member has a transversely extending base portion, a first arm portion, which is extending from the base portion at a first angle $\alpha_a$, and an opposite, second arm portion, which is extending from the base portion at a second angle $\alpha_b$, and wherein the end of the first arm portion is directly connected to the first side frame base rail and the end of the second arm portion is directly connected to the second side frame base rail, respectively; (iv) a pair of upstanding side plate members, fixedly connected approximately midway between the front and rear frame base rails to respective ones of the side frame base rails substantially at positions of connection thereof with the first arm portion and second arm portion, respectively; and (v) a support member configured to engage with the motor member and mounted to the force balance member and the rear frame base rail at the strategic position, wherein the motor member is pivotally connected to the support member of the support frame for actuating motion of the motor member upon extension or retraction of the motor member shaft portion, thereby causing the seat portion to move from a first position to a second position in operation, and wherein the strategic position is substantially coincident with the geometric center of the rear frame base rail.

17. The lift chair of claim 16, wherein the support member comprises a first L-shaped side plate member and a spaced apart, second L-shaped side plate member, which are respectively connected to a base plate member, and wherein the first L-shaped side plate member, second L-shaped side plate member and base plate member are configured such that when the support member is mounted to the force balance member and the rear frame base rail at the strategic position, a lower side of the first L-shaped side plate member is fixedly connected to and supported by an upper side of the rear frame base rail at a corresponding position, a contact side of the first L-shaped side plate member is fixedly connected to the transversely extending base portion of the force balance member at a corresponding position, a lower side of the second L-shaped side plate member is fixedly connected to and supported by the upper side of the rear frame base rail at a corresponding position, a contact side of the second L-shaped side plate member is fixedly connected to the transversely extending base portion of the force balance member at a corresponding position, and a side of the base plate member is fixedly connected to the transversely extending base portion of the force balance member at a corresponding position, respectively.

18. The lift chair of claim 17, wherein each of the first L-shaped side plate member and second L-shaped side plate member defines a hole.

19. The lift chair of claim 16, wherein the first angle $\alpha_a$ is nonzero and smaller than 90°, and the second angle $\alpha_b$ is nonzero and smaller than 90°.

20. The lift chair of claim 19, wherein the first arm portion of the force balance member and corresponding portions of the rear frame base rail and side frame base rail enclose an area that is substantially triangular.

21. The lift chair of claim 20, wherein the second arm portion of the force balance member and corresponding portions of the rear frame base rail and side frame base rail enclose an area that is substantially triangular.

22. The lift chair of claim 19, wherein the first angle $\alpha_a$ and the second angle $\alpha_b$ are different or substantially same.

23. The lift chair of claim 16, further comprising at least one of a back portion, a leg support portion, and a foot rest portion.

24. The lift chair of claim 23, further comprising driving means for moving at least one of the back portion, leg support portion, and foot rest portion in response to the motor causing the seat portion to move from the first position to the second position, or vice versa.

25. The lift chair of claim 23, wherein the support frame further comprises a lifting member for lifting the seat portion, back portion, and leg support portion of the lift chair into a desired position, comprising:

(a) an elevator frame having:

(i) longitudinally spaced transversely extending front and rear elevator frame members, each of the front and rear elevator frame members having a central portion, intermediate portions extending generally downwardly from respective end portions of the central portion and being connected thereto via a gentle curvature, and extremity portions extending outwardly in a gentle curvature in a transverse direction from respective lower portions of the intermediate extending portions;

(ii) a pair of transversely spaced longitudinally extending elevator frame side members, rigidly connected to respective end portions of the central portions of the front and rear elevator frame members, such that the pair of transversely spaced longitudinally extending elevator frame side members and the central portions of the front and rear elevator frame members are co-planar, wherein each of the pair of transversely spaced longitudinally extending elevator frame side members has a tab extending from one end portion of the elevator frame side member that is connected to the front elevator frame members; and (iii) a pair of transversely spaced longitudinally extending elevator frame side rails, rigidly connected to respective ends of the extremity portions of the front and rear elevator frame members, such that the pair of transversely spaced longitudinally extending elevator frame side rails and the extremity portions of the front and rear elevator frame members are co-planar;

(b) a first pair of transversely spaced longitudinally extending elevator arms rigidly connected by one or more transversely extending bars, each of the first pair of transversely spaced longitudinally extending elevator arms having a first end portion and an opposite, second end portion, wherein the first end portions of the first pair of transversely spaced longitudinally extending elevator arms are pivotally mounted to respective ones of the extending tabs of the pair of transversely spaced longitudinally extending elevator frame side members, and the second end portions of the first pair of transversely spaced longitudinally extending elevator arms are pivotally mounted to respective ones of the pair of upstanding side plate members, respectively; and (c) a second pair of transversely spaced longitudinally extending elevator arms rigidly connected by one or more transversely extending bars, each of the second pair of transversely spaced longitudinally extending elevator arms having a first end portion and an opposite, second end portion, wherein the first end portions of the second pair of transversely spaced longitudinally extending elevator arms are pivotally mounted to respective ones of the extending tabs of the pair of transversely spaced longitudinally extending elevator frame side members, and the second end portions of the second pair of transversely spaced longitudinally extending elevator arms are pivotally mounted to respective ones of the pair of upstanding side plate members, respectively, such that the elevator frame is operably movable from a first position to a second position relative to the support frame, and vice versa.

26. The lift chair of claim 25, wherein when the elevator frame further comprises an engaging member rigidly connected to a position of the central portion of the front elevator frame members.

27. The lift chair of claim 26, further comprising a crank member having a first end portion pivotally connected to the engaging member of the elevator frame and a second end portion pivotally connected to the motor shaft portion for rotation responsively to extension or retraction of the motor shaft portion.

* * * * *